US007383614B2

(12) United States Patent
Matsuki

(10) Patent No.: US 7,383,614 B2
(45) Date of Patent: Jun. 10, 2008

(54) DOOR CHECKER FOR AUTOMOBILE

(75) Inventor: Katsuhiro Matsuki, Saitama (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 11/034,207

(22) Filed: Jan. 13, 2005

(65) Prior Publication Data

US 2006/0150366 A1 Jul. 13, 2006

(51) Int. Cl.
*E05F 5/06* (2006.01)

(52) U.S. Cl. ..... 16/86 B; 16/86 C; 16/86 A; 16/86 R; 16/85; 16/82; 296/146.12; 296/146.11

(58) Field of Classification Search ..... 16/82, 16/85, 86 R, 86 A, 86 B, 86 C; 296/146.12, 296/146.11

See application file for complete search history.

(56) References Cited

U.S. PATENT DOCUMENTS

| | | | | |
|---|---|---|---|---|
| 2,290,331 | A * | 7/1942 | Jacobs | 16/86 C |
| 2,291,412 | A * | 7/1942 | Schonitzer | 16/86 C |
| 5,474,344 | A * | 12/1995 | Lee | 292/262 |
| 6,370,733 | B2 * | 4/2002 | Paton et al. | 16/86 C |
| 6,446,305 | B1 * | 9/2002 | Kneeland | 16/82 |
| 6,467,126 | B1 * | 10/2002 | Yezersky et al. | 16/86 C |
| 6,813,811 | B2 * | 11/2004 | Matsuki et al. | 16/86 B |
| 6,871,382 | B2 * | 3/2005 | Murayama et al. | 16/82 |
| 2003/0051312 | A1 * | 3/2003 | Hoffmann et al. | 16/50 |

FOREIGN PATENT DOCUMENTS

| | | |
|---|---|---|
| JP | 5-47273 | 6/1993 |
| JP | 9-256714 | 9/1997 |
| JP | 11-101046 | 4/1999 |
| JP | 11-303487 | 11/1999 |

* cited by examiner

*Primary Examiner*—Robert J. Sandy
*Assistant Examiner*—Marcus Menezes
(74) *Attorney, Agent, or Firm*—Arent Fox LLP

(57) ABSTRACT

A door checker includes: a check lever 6 formed, at the proximal end thereof, with a boss 10 connected to a bracket 7 via a shaft 8; a case 1 having through holes 4, 5 through which the check lever 6 passes; and shoes 19 which are in sliding contact with detent surfaces 9 of the check lever 6 in the case 1. The check lever 6 is provided, at the distal end thereof, with a full open stopper 12 which comes into contact with an outside surface of the case 1 to define a full open position of a door D. The full open stopper 12 is formed integrally with the check lever 6. The boss 10 is formed so as to be capable of passing through the through holes 4, 5 in the case 1 and between the pair of shoes 19. Therefore, the door checker for an automobile can be assembled while eliminating a process of installing the full open stopper to the check lever.

4 Claims, 10 Drawing Sheets

DOOR CHECKER FOR AUTOMOBILE

BACKGROUND OF THE INVENTION

1. Field of the Invention

The present invention relates to a door checker for an automobile. More particularly, the present invention relates to an improvement of a door checker for an automobile, which includes: a check lever formed, at the proximal end thereof, with a boss connected swingingly to a bracket fixed to a body of the automobile via a shaft; a case having through holes through which the check lever passes through, the case being fixed to a door hinge-connected to the body; a pair of shoes which are housed in the case and in sliding contact with detent surfaces of the check lever; and elastic members which are housed in the case and urge the shoes toward the detent surfaces, the check lever being provided, at the distal end thereof, with a full open stopper which comes into contact with the external end wall of the case to define a full open position of the door, and the shoes being integrally formed with a pair of guide walls which are in sliding contact with both side surfaces arranged in a width direction of the detent surfaces of the check lever.

2. Description of the Related Art

Such a door checker for an automobile has already been known as disclosed, for example, in Japanese Patent Application Laid-open No. 11-303487.

In this conventional door checker for an automobile, since a boss having a relatively large diameter is formed at the proximal end of a check lever, during assembly, the check lever is inserted between a case and a pair of shoes with the distal end of the check lever at the forefront, and after the insertion, a full open stopper is installed at the distal end of the lever.

Therefore, in assembling the door checker for an automobile, a process of installing the full open stopper to the check lever is indispensable. If this installing process can be eliminated, the number of assembling steps will accordingly be decreased, so that the manufacturing cost can be reduced.

SUMMARY OF THE INVENTION

The present invention has been made in view of the above situation, and an object thereof is to provide a door checker for an automobile, which can be assembled while eliminating a process of installing a full open stopper to a check lever.

To achieve the above object, according to a first feature of the present invention, there is provided a door checker for an automobile, comprising: a check lever formed, at the proximal end thereof, with a boss connected swingingly to a bracket fixed to a body of the automobile via a shaft; a case having through holes through which the check lever passes through, the case being fixed to a door hinge-connected to the body; a pair of shoes which are housed in the case and in sliding contact with detent surfaces of the check lever; and elastic members which are housed in the case and urge the shoes toward the detent surfaces, the check lever being provided, at the distal end thereof, with a full open stopper which comes into contact with the external end wall of the case to define the full open position of a door, and the shoes being integrally formed with a pair of guide walls which are in sliding contact with both side surfaces arranged in a width direction of the detent surfaces of the check lever, characterized in that the full open stopper is formed integrally with the check lever, and wherein the boss is formed so as to be capable of passing through the through holes in the case and between the pair of shoes.

The elastic member corresponds to a rubber spring in the later-described embodiment of the present invention.

According the first feature, a process of installing the full open stopper to the check lever, which has conventionally been performed after the check lever has been inserted in the case, is eliminated, so that the number of assembling steps can be decreased, which contributes to a reduction in the manufacturing cost.

Also, according to a second feature of the present invention, in addition to the first feature, the boss is formed so as to have a diameter larger than the width of the detent surfaces, and wherein a pair of expanding portions capable of passing between the pair of guide walls of the shoes are formed on both end surfaces in the axial direction of the boss, so that when the expanding portions pass between the pair of guide walls, the outer peripheral portion of the boss can pass between the pair of shoes.

According to the second feature, although the boss of the check lever has a diameter larger than the width of the detent surface, the boss can be caused to pass between the shoes while avoiding the interference with the guide walls of the shoes by widening a clearance between the pair of shoes by means of the expanding portions of the boss, so that the door checker can be assembled without trouble. Also, by forming the boss so as to have a diameter larger than the width of the detent surface, the diameter of a shaft hole in the boss is made as large as possible to enable the use of a shaft having as large diameter as possible, whereby a sufficient connection strength can be ensured between the check lever and the bracket.

Further, according to a third feature of the present invention, in addition to the second feature, the boss is formed with a wedge-shaped portion for widening the clearance between the pair of shoes when the boss is inserted between the pair of shoes.

According the third feature, by inserting the wedge-shaped portion of the boss in between the shoes before the clearance between the pair of shoes is widened by the expanding portions of the boss, the expanding portions are easily inserted in between the shoes, whereby the clearance between the shoes can be widened, so that the assemblability can be improved.

These and other objects, features, and advantages will become more apparent in the explanation of preferred embodiment described in detail below with reference to the accompanying drawings.

DESCRIPTION OF THE PREFERRED EMBODIMENT

A preferred embodiment of the present invention will now be described with reference to the accompanying drawings.

Figure 1:
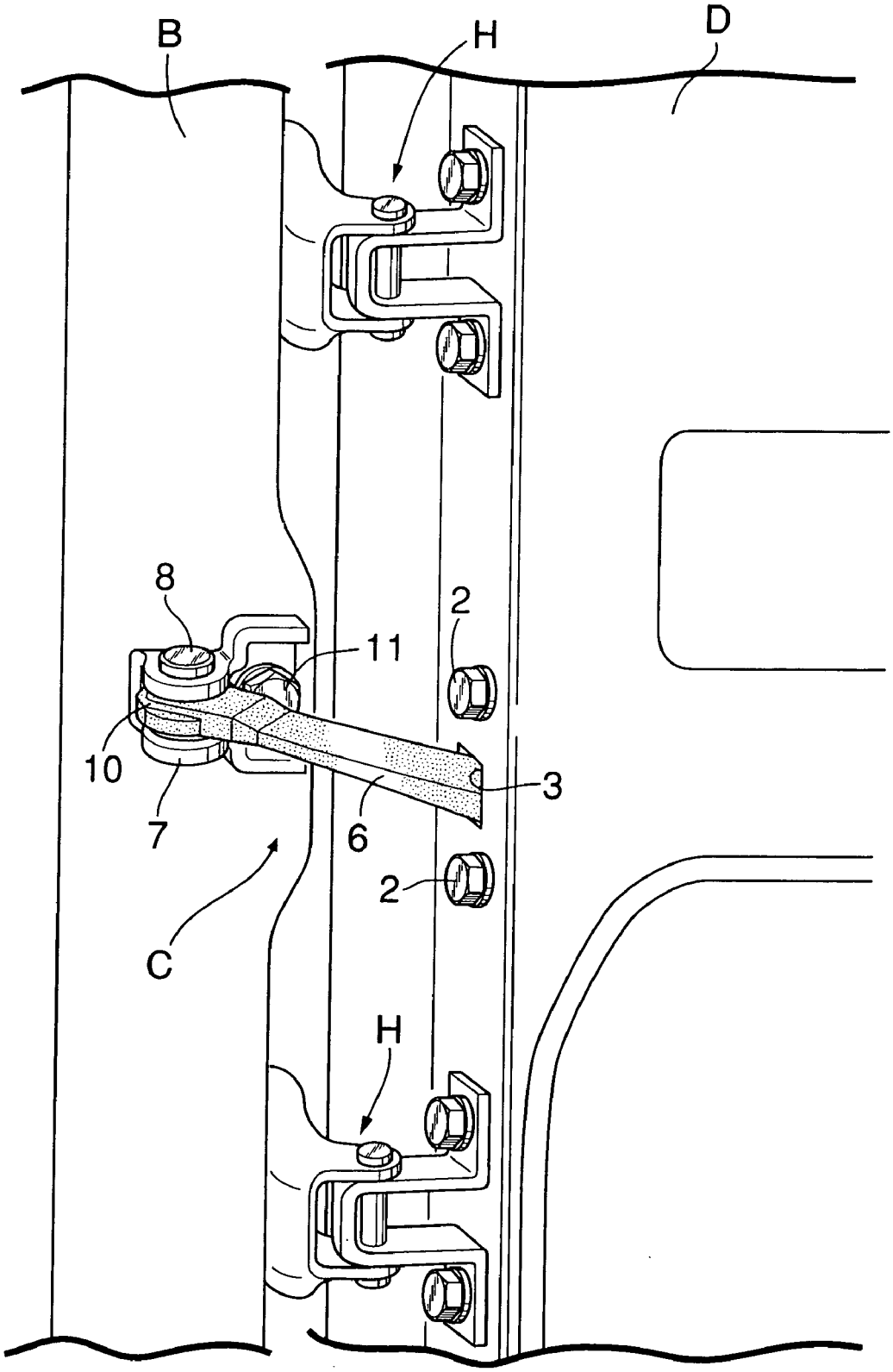
FIG. 1 is a perspective view of an essential portion of an automobile provided with a door checker in accordance with an embodiment of the present invention.

First, in FIG. 1, a door D is connected to a vehicle body B via hinges H so as to be turnable to open and close an entrance/exit opening in the vehicle body B. A door checker C in accordance with the present invention for the door D is installed between the body B and the door D.

Figure 2:
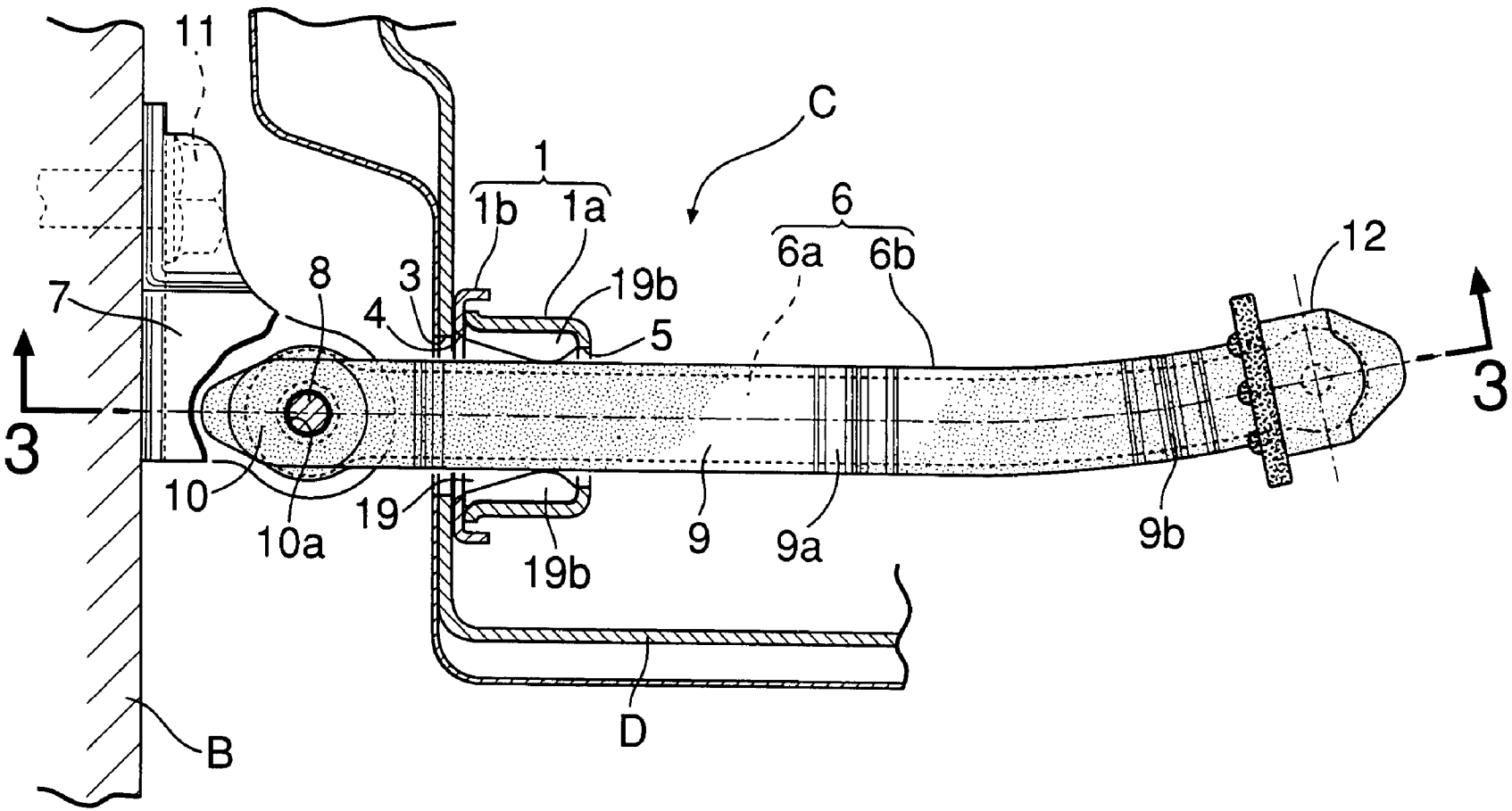
FIG. 2 is a plan view of the door checker.
Figure 3:
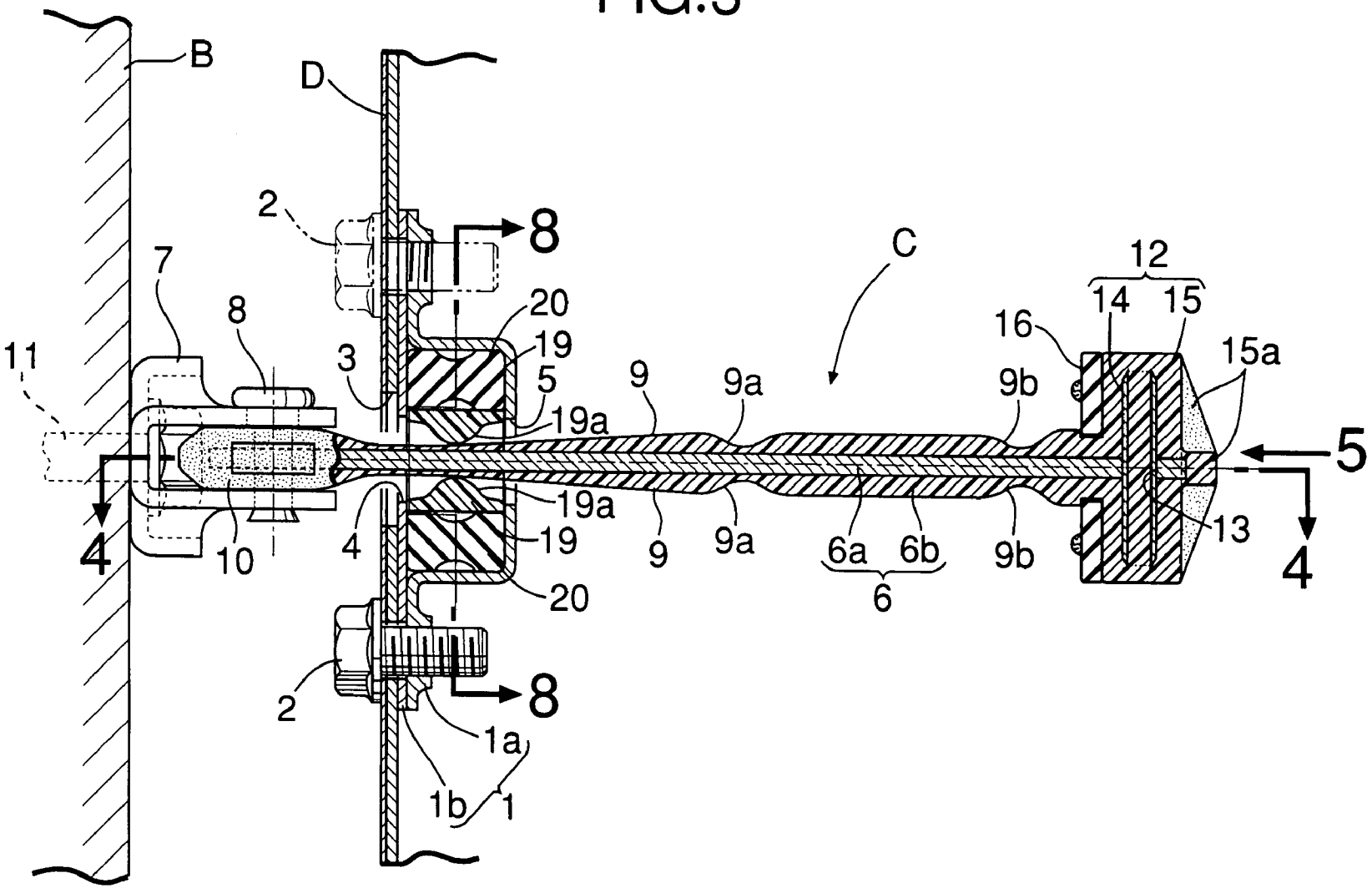
FIG. 3 is a sectional view taken along the line 3-3 of FIG. 2.

As shown in FIGS. 2 and 3, the door checker C has a case 1 fixed to the internal surface of an end wall of the door D with a plurality of bolts 2, 2. The case 1 includes: a case body 1*a* of a box shape whose one end is open; and a cover 1*b* which is connected to the case body 1*a* so as to cover the open end of the case body 1*a* and which is held between the case body 1*a* and the inner surface of the end wall of the door D. The cover 1*b* and the case body 1*a* are formed with through holes 4 and 5, respectively, which are arranged coaxially with a through hole 3 formed in the end wall of the door D. A check lever 6 is provided so as to pass through these three through holes 3, 4 and 5.

The check lever 6 has a boss 10 at the proximal end projecting outward from the door D. The boss 10 is connected turnably to a bracket 7 via a shaft 8 inserted into a shaft hole 10*a* of the boss 10. The bracket 7 is fixed to the body D with a plurality of bolts 11, 11 so that the shaft 8 is parallel with pivot shafts of the hinges H.

The check lever 6 includes: a core plate 6*a* made of a steel plate; and a synthetic resin skin 6*b* mold-connected to the peripheral surface of the core plate 6*a*. The skin 6*b* is formed so that the thickness of the check lever 6 gradually increases from a neck portion of the boss 10 toward an intermediate portion of the lever 6. Opposite surfaces arranged in the thickness direction of the check lever 6 are detent surfaces 9, 9. On the detent surfaces 9, 9, a half open detent notch 9*a* and a full open detent notch 9*b* are formed in that order from the boss 10 side. A full open stopper 12 adjacent to the full open detent notch 9*b* is provided integrally in a distal end portion of the check lever 6.

Figure 4:
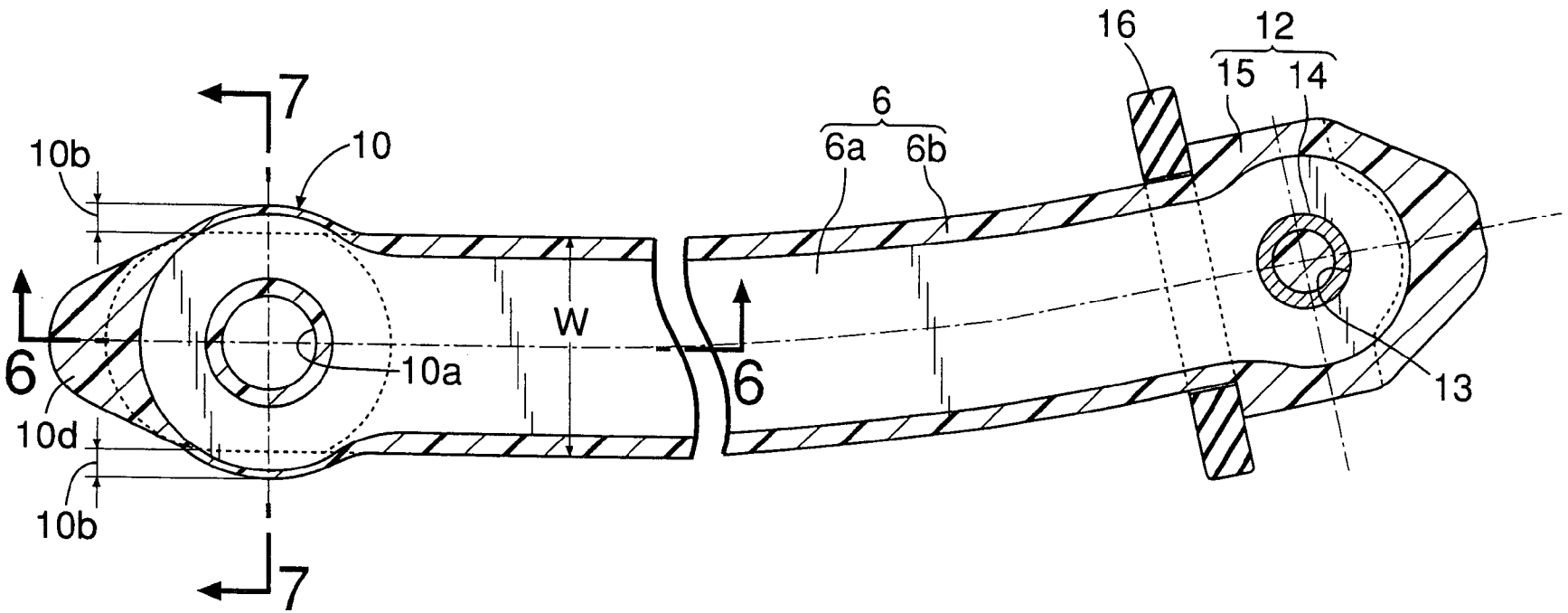
FIG. 4 is an enlarged sectional view of a check lever taken along the line 4-4 of FIG. 3.
Figure 5:
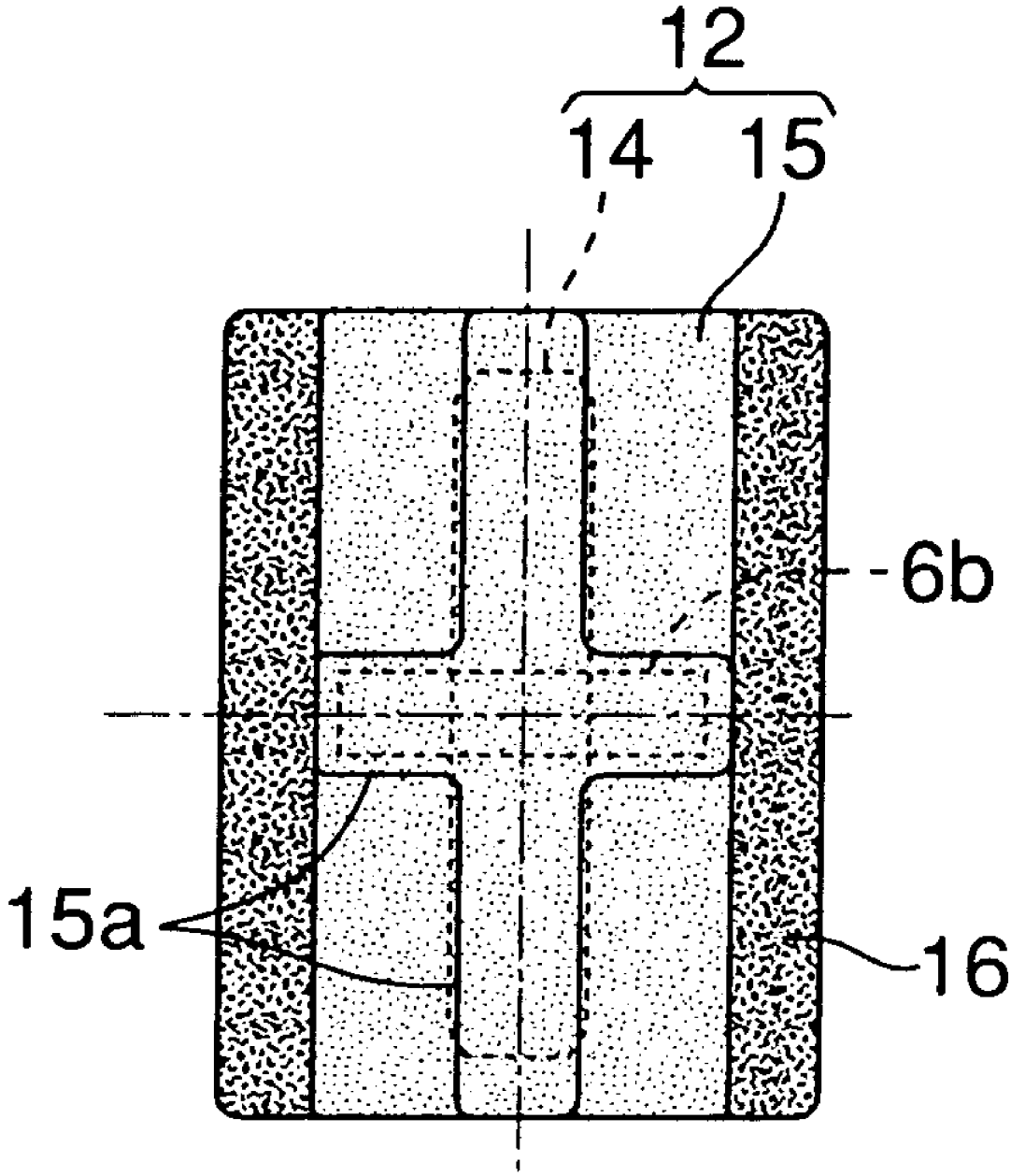
FIG. 5 is a view taken in the direction of the arrow 5 of FIG. 3.

As shown in FIGS. 4 and 5, the full open stopper 12 includes: a hollow anchor pin 14 which is fitted in a pin hole 13 formed in a distal end portion of the core plate 6*a* and whose opposite ends project from the core plate 6*a*; and a synthetic resin bulging portion 15 which is charged into a hollow portion of the anchor pin 14 and mold-connected to the peripheral surfaces of the distal end of the core plate 6*a* and the anchor pin 14 so as to connect the distal end of the core plate 6*a* and the anchor pin 14 to each other. The bulging portion 15 is formed integrally with the skin 6*b*. The sectional shape of the bulging portion 15 in the direction perpendicular to the lengthwise direction of the check lever 6 is a rectangular shape in which the axial direction of the anchor pin 14 is the long side. A cross-shaped reinforcing rib 15*a* is integrally formed on the external end face of the bulging portion 15. A plate-shaped rubber cushion member 16, which is fitted on the check lever 6 and faces the case 1, is disposed on the internal end surface of the bulging portion 15. By bringing the outside surface of the case 1 into contact with the bulging portion 15 via the cushion member 16, the full open of the door D is defined.

As shown in FIGS. 2, 3, 8 and 9, the case 1 houses a pair of synthetic resin shoes 19, 19 which are in sliding contact with both the detent surfaces 9, 9 of the check lever 6, and a pair of rubber springs 20, 20 which urge the shoes 19, 19 toward the detent surfaces 9, 9. Each of the rubber springs 20, 20 is mounted, in a compressed state, between positioning concave portions 21, 21 on the back surface of the shoe 19 and the internal wall of the case 1 facing the positioning concave portions 21, 21.

Each of the shoes 19, 19 is integrally formed with a semi-cylindrical engagement portion 19*a* which engages with the half open detent notch 9*a* and the full open detent notch 9*b*, and a pair of guide walls 19*b*, 19*b* which are in sliding contact with both side surfaces arranged in the width direction of the detent surfaces 9, 9 of the check lever 6.

Figure 6:
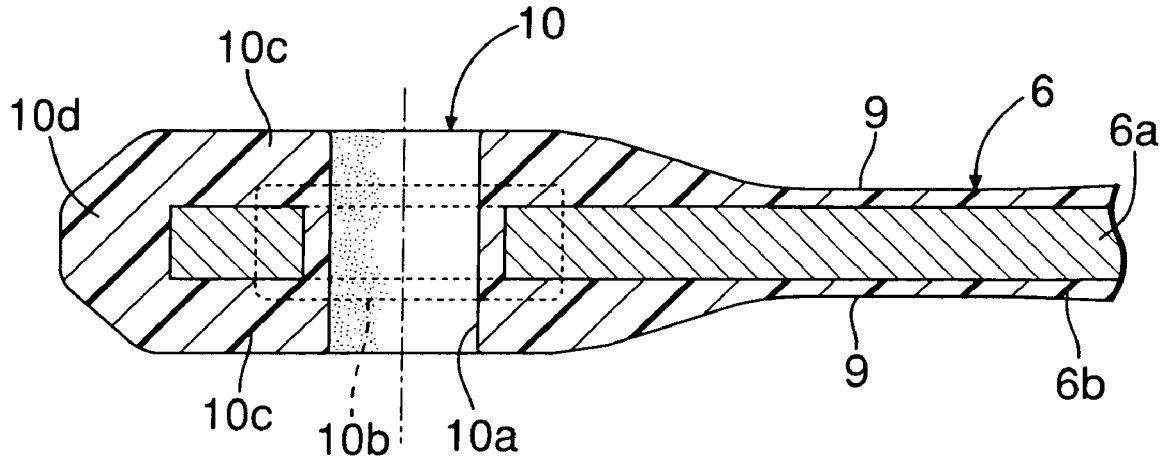
FIG. 6 is an enlarged sectional view taken along the line 6-6 of FIG. 4.
Figure 7:
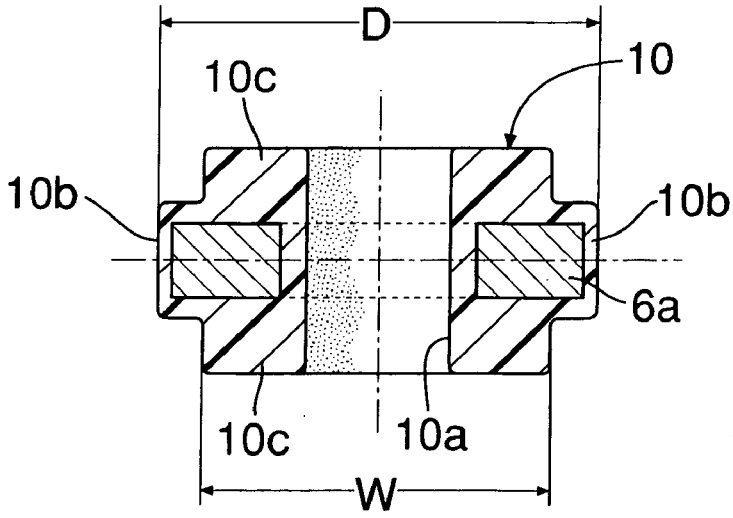
FIG. 7 is an enlarged sectional view taken along the line 7-7 of FIG. 4.
Figure 8:
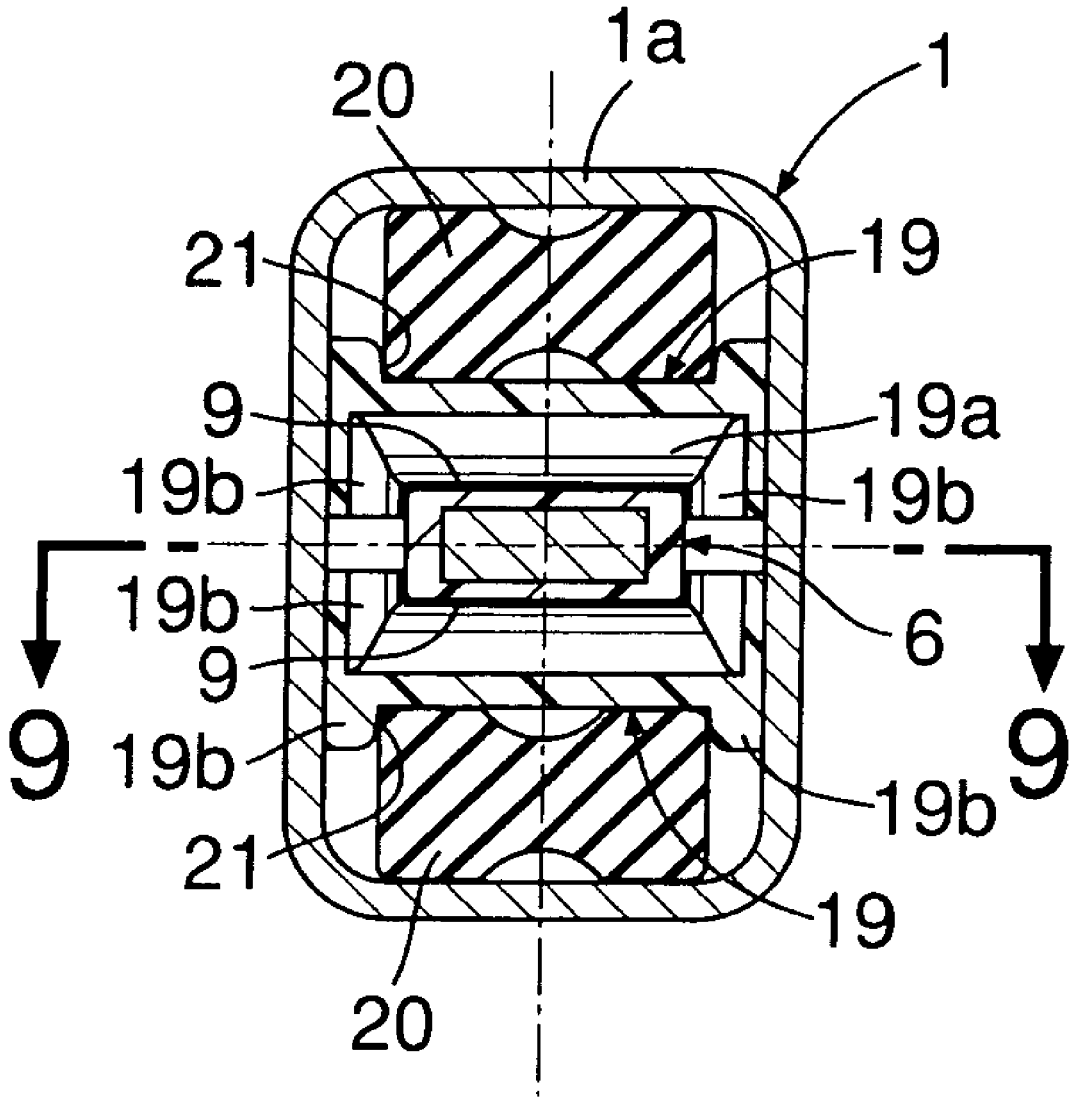
FIG. 8 is an enlarged sectional view taken along the line 8-8 of FIG. 3.
Figure 9:
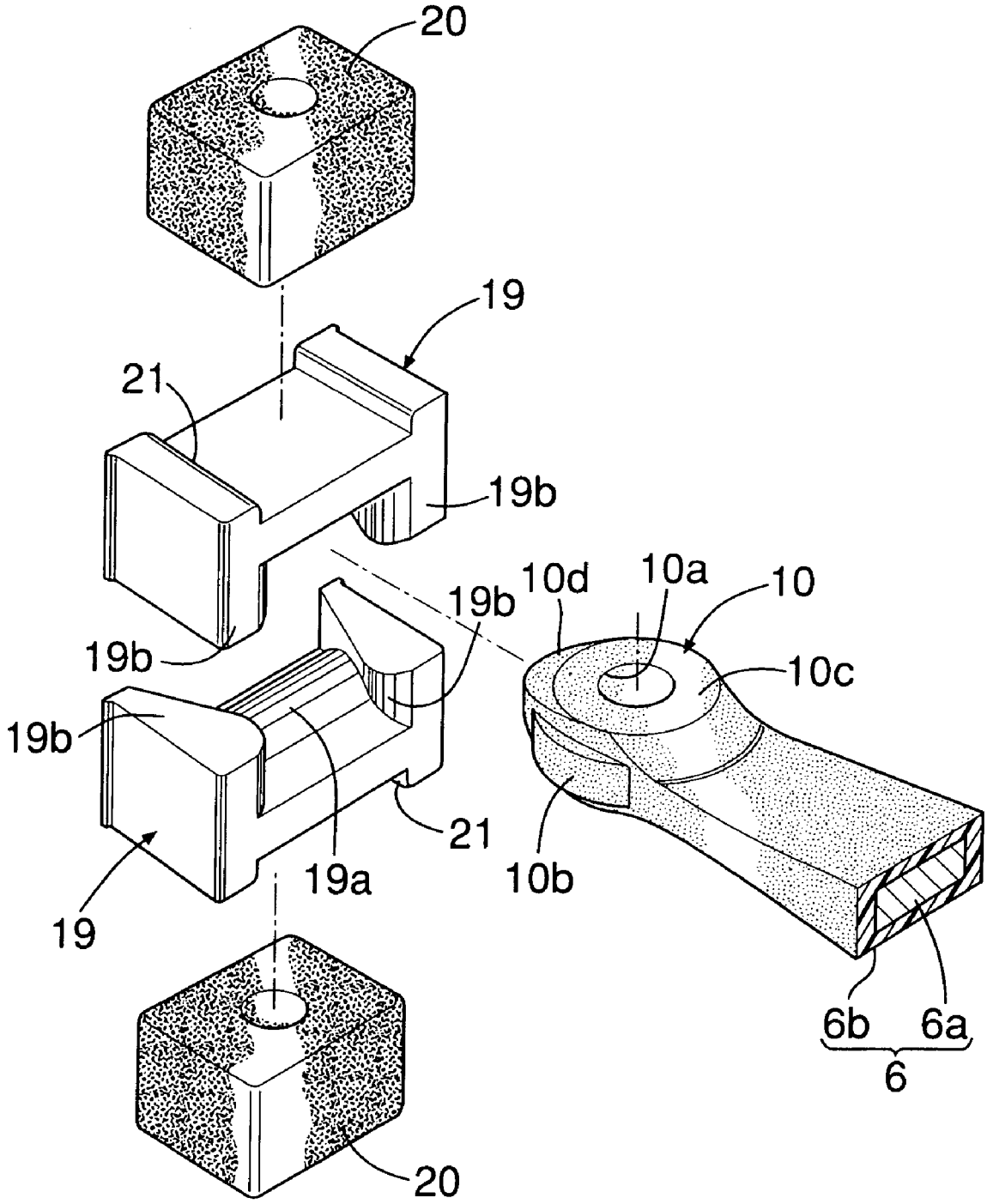
FIG. 9 is an exploded perspective view of an essential portion of the door checker.

In FIGS. 4, 6 and 7, the boss 10 is formed to have a diameter D larger than the width W of the detent surfaces 9, 9. Therefore, the peripheral surface of the boss 10 projects from both the side surfaces of the check lever 6. The pair of side projecting portions are denoted by reference symbols 10*b*, 10*b*. On the other hand, the through holes 3 to 5 in the door D and the case 1 are formed to have a size capable of allowing the boss 10 to pass therethrough.

Also, on opposite end surfaces in the axial direction of the boss 10, there are formed a pair of expanding portions 10*c*, 10*c* which can pass between the pair of guide walls 19*b*, 19*b*. When the expanding portions 10*c*, 10*c* pass between the pair of guide walls 19*b*, 19*b*, the side projecting portion 10*b* can pass between the pair of shoes 19, 19. The expanding portions 10*c*, 10*c* are molded integrally with the skin 6*b*.

Further, the boss 10 is formed with a wedge-shaped portion 10*d* for widening a clearance between the pair of shoes 19, 19 when the boss 10 is inserted between the pair of shoes 19, 19. The wedge-shaped portion 10*d* is also molded integrally with the skin 6*b*.

Next, the operation of this embodiment will be explained.

Figure 10A:
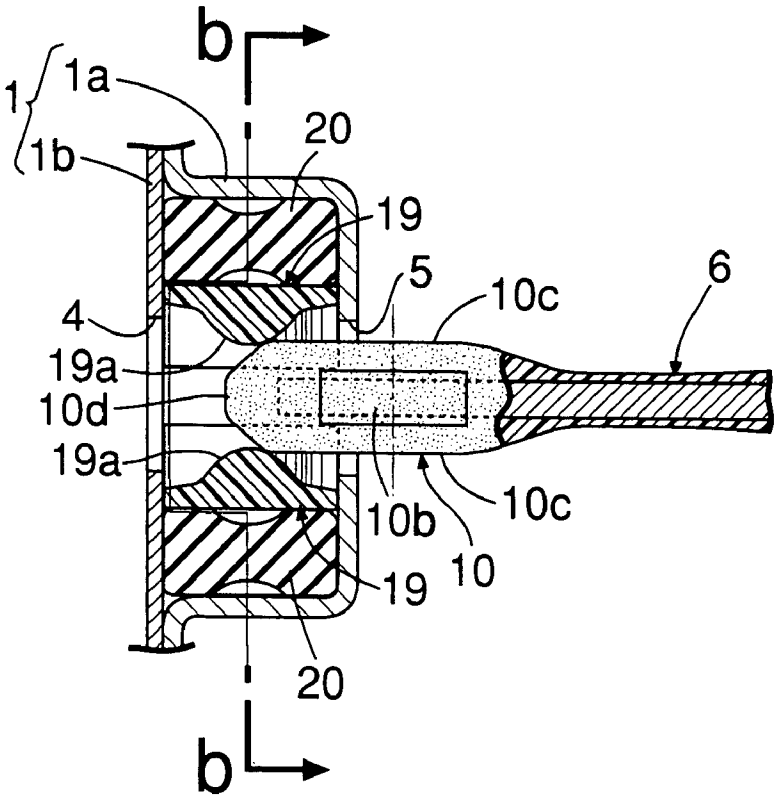
FIGS. 10A, 10B and 10C are views for illustrating the operation at an assembly stage of the door checker.
Figure 10B:
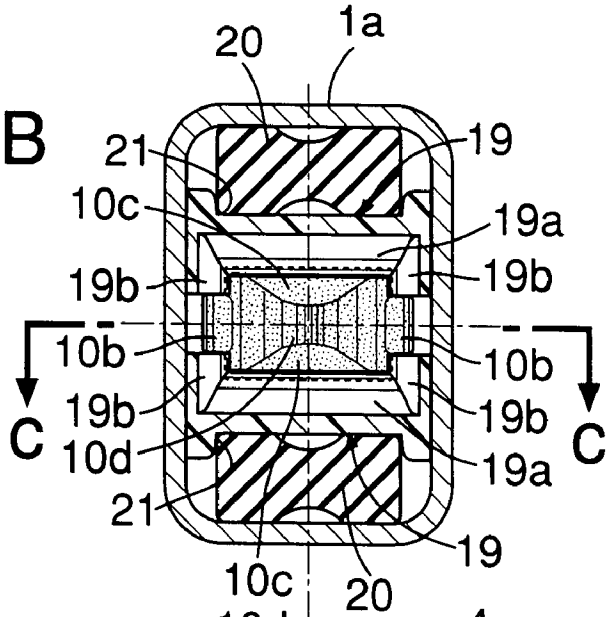
Figure 10C:
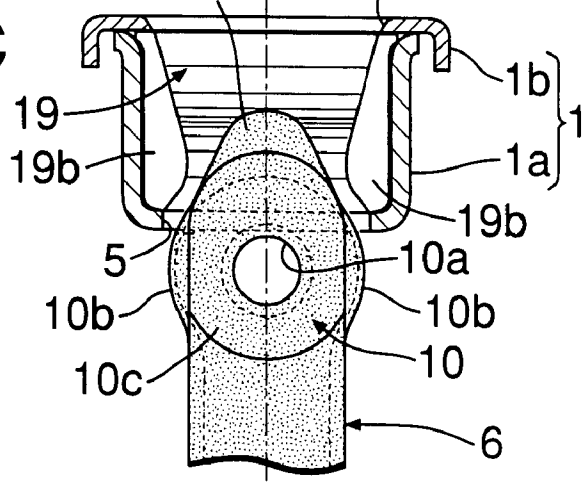

In assembling the door checker C, first, the shoes 19, 19 and the rubber springs 20, 20 are put in the case body 1*a*, and then the cover 1*b* is connected to the case body 1*a*. Next, as shown in FIGS. 10A, 10B and 10C, the check lever 6 is pushed in between the pair of shoes 19, 19 through the through hole 5 in the case body 1*a*, with the wedge-shaped portion 10*d* of the boss 10 at the head of the check lever 6. Since the wedge-shaped portion 10*d* smoothly widens the clearance between the pair of shoes 19, 19 while compressing the rubber springs 20, 20, the expanding portions 10*c*, 10*c* of the boss 10 following the wedge-shaped portion 10*d* can be inserted easily between the shoes 19, 19.

Figure 11A:
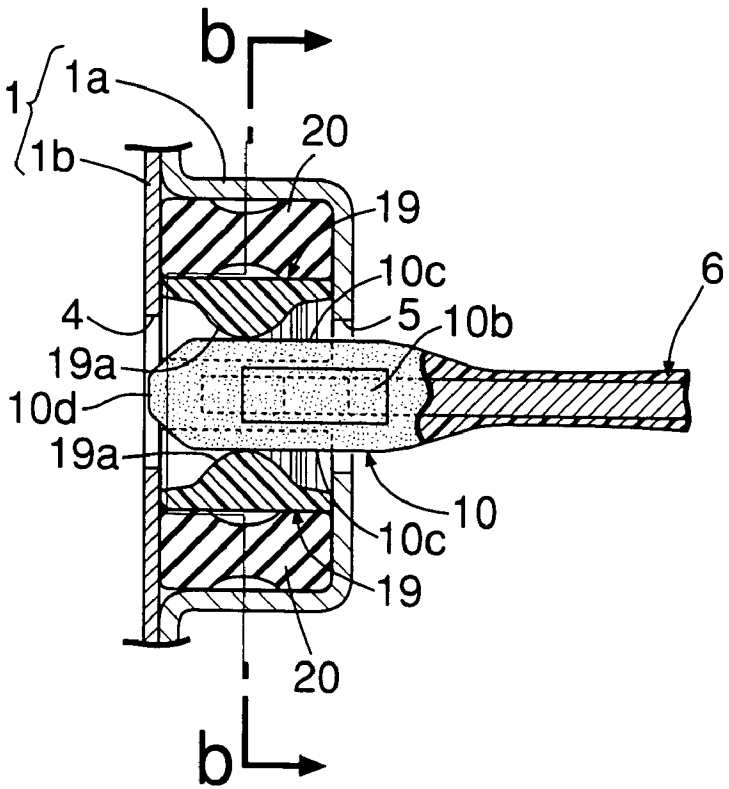
FIGS. 11A, 11B and 11C are views for illustrating the operation at another assembly stage.
Figure 11B:
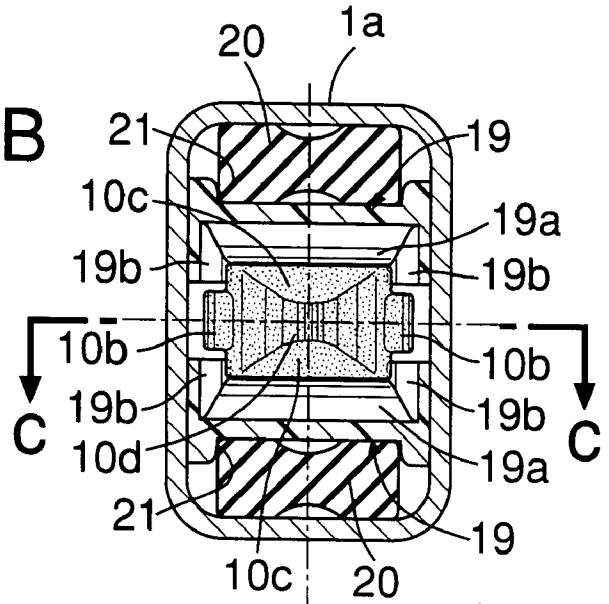
Figure 11C:
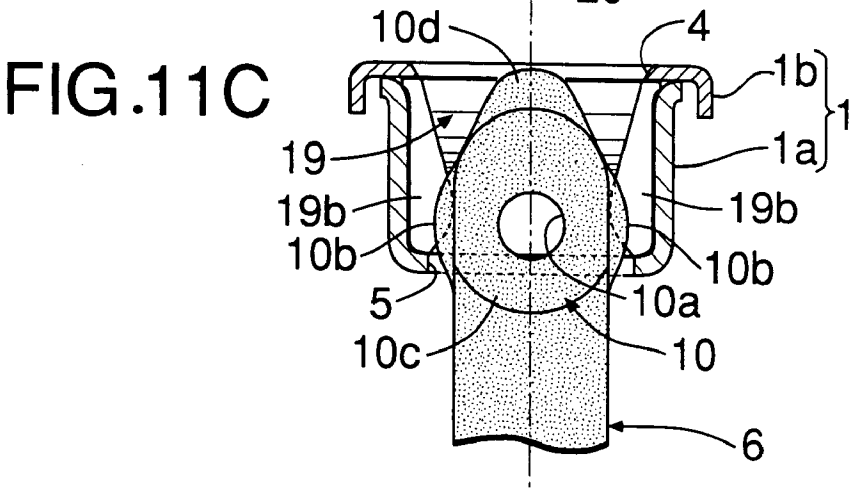

After the expanding portions 10*c*, 10*c* of the boss 10 have been inserted between the shoes 19, 19, the side projecting portions 10*b*, 10*b* of the boss 10 can pass between the shoes 19, 19 without being interfered by the guide walls 19*b*, 19*b* as shown in FIGS. 11A, 11B and 11C. Therefore, by further pushing the check lever 6 in between the shoes 19, 19, the boss 10 is allowed to pass between the shoes 19, 19, and further pass through the through hole 4 in the cover 1*b*. To the boss 10 having passed through the cover 1*b*, the bracket 7 is connected via the shaft 8.

In the full open stopper 12, since the bulging portion 15 that wraps the anchor pin 14 is molded integrally with the synthetic resin skin 6B of the check lever 6, the full open stopper 12 can be constructed simultaneously with the manufacture of the check lever 6. Therefore, when the door checker C is assembled, the number of assembling steps can be decreased by eliminating a process of installing the full open stopper 12. Moreover, the bulging portion 15 is used not only as a stopper plate but also as an element for preventing the anchor pin 14 from coming off from the core plate 6*a*. Therefore, the number of parts is decreased, and the structure is simplified, which effectively reduces the cost owing to the reduced number of assembling steps.

Furthermore, although the boss 10 of the check lever 6 has a diameter larger than the width W of the detent surface 9, as described above, the wedge-shaped portion 10*d* guides the expanding portions 10*c*, 10*c* to a position between the shoes 19, 19, and causes the boss 10 to pass between the shoes 19, 19 smoothly while avoiding the interference between the side projecting portions 10*b*, 10*b* and the guide walls 19*b*, 19*b* of the shoes 19, 19. Therefore, the assemblability of the door checker C is high. By forming the boss 10 so as to have a diameter larger than the width W of the detent surface 9, the diameter of the shaft hole 10*a* in the boss 10 is made as large as possible to enable the use of the shaft 8 having as large diameter as possible, whereby a sufficient connection strength can be ensured between the check lever 6 and the bracket 7.

In installing the door checker C to the body B of an automobile: the door checker C with the bracket 7 is inserted into the door D through an opening (not shown) in an inner panel of the door D; the bracket 7 is pulled out to the outside through the through hole 3 in the end wall of the door D; and the case 1 is fixed to the end wall of the door D with the bolts 2, 2. Then, the bracket 7 is fixed at a predetermined position of the body B with the bolts 11, 11, whereby the installation work is finished.

When the door D is open from the closed state, the engagement portions 19*a*, 19*a* of the shoes 19, 19 slidingly climb the upgrade detent surfaces 9, 9 of the check lever 6, and accordingly the rubber springs 20, 20 are compressed. Therefore, the pressing force of the shoes 19, 19 on the detent surfaces 9, 9 is increased by an increase in the resilience of the rubber springs 20, 20, and accordingly the opening torque of the door D properly increases.

When the door D is opened to a predetermined half open position, the engagement portions 19*a*, 19*a* of the shoes 19, 19 fall into the half open detent notches 9*a*, 9*a* on the detent surfaces 9, 9, whereby the door D can be held at the predetermined half open position.

When an opening force is further applied to the door D to cause the engagement portions 19*a*, 19*a* of the shoes 19, 19 to get out of the half open detent notches 9*a*, 9*a*, the engagement portions 19*a*, 19*a* fall into the full open detent notches 9*b*, 9*b*, and at the same time, the full open stopper 12 is received by the case 1, whereby the door D is stopped and held at the full open position. At this time, the opening force of the door D is transmitted to the bulging portion 15 made of a synthetic resin after being absorbed by the cushion member 16. Since the bulging portion 15 is effectively reinforced by the anchor pin 14 which is fitted on the core plate 6*a* and embedded in the bulging portion 15, and the reinforcing rib 15*a* formed on the back face of the bulging portion 15, the bulging portion 15 can firmly receive the opening force of the door D.

The present invention is not limited to the above-described embodiment, and various design changes can be made without departing from the subject matter of the invention. For example, as the engagement portion 19*a* of the shoes 19, 19, a roller may be mounted, and in place of the rubber springs 20, 20, metallic springs may be used.

What is claimed is:

1. A door checker for an automobile, comprising:

a check lever formed, at a proximal end thereof, with a boss swingingly connected to a bracket fixed to a body of the automobile via a shaft; a case having through holes through which the check lever passes, the case being fixed to a door hinge-connected to the body;

a pair of shoes housed in the case and in sliding contact with detent surfaces of the check lever; and elastic members housed in the case, wherein the elastic members urge the shoes toward the detent surfaces, wherein the check lever is provided, at a distal end thereof, with a full open stopper which comes into contact with an external end wall of the case to define a full open position of the door, wherein the shoes are each integrally formed with:

an engagement portion which engages the mating detent surface of the check lever, and a pair of guide walls extending in a direction orthogonal from the engagement portion and which are placed in sliding contact with both side surfaces of the check lever, which are arranged in a width direction of the detent surfaces of the check lever, wherein the full open stopper is formed integrally with the check lever, and wherein the pair of guide walls of one of the shoes are spaced from the pair of guide walls of the other of the shoes in the orthogonal direction and the boss is formed to be capable of passing through the through holes in the case and between the pairs of shoes while avoiding interference of the boss with the guide walls of the shoes when the check lever is being assembled into the case.

2. The door checker for an automobile according to claim 1, wherein in the width direction of the detent surfaces, the boss has a diameter larger than the width of the detent surfaces, and wherein a pair of expanding portions capable of passing between the pairs of guide walls of the shoes are formed on both end surfaces in an axial direction of the boss, so that when the expanding portions pass between the pairs of guide walls, an outer peripheral portion of the boss can pass between the pair of shoes.

3. The door checker for an automobile according to claim 2, wherein the boss is formed with a wedge-shaped portion which widens a clearance defined between the pair of shoes when the boss is inserted between the pair of shoes.

4. The door checker for an automobile according to claim 1, wherein the boss includes a pair of side projecting portions projecting from said side surfaces of the check lever.

* * * * *